United States Patent [19]

Arai et al.

[11] 3,954,478

[45] May 4, 1976

[54] SILVER HALIDE EMULSION CONTAINING AN ALKENYL BENZOTHIAZOLIUM SALT AS STABILIZER

[75] Inventors: Naoki Arai; Reiichi Ohi, both of Minami-ashigara, Japan

[73] Assignee: Fuji Photo Film Co., Ltd., Minami-ashigara, Japan

[22] Filed: Dec. 23, 1974

[21] Appl. No.: 535,659

[30] Foreign Application Priority Data

Dec. 21, 1973 Japan ..... 49-3114

[52] U.S. Cl. ..... 96/100; 96/107; 96/120; 96/109; 260/304 R

[51] Int. Cl.[2] ..... G03C 1/34

[58] Field of Search ..... 96/100, 107, 109, 120; 260/304 H, 304 C

[56] References Cited

UNITED STATES PATENTS

| | | | |
|---|---|---|---|
| 2,131,038 | 9/1938 | Brooker et al. | 96/109 |
| 3,326,681 | 6/1967 | Walworth | 96/109 |
| 3,881,939 | 5/1975 | Noda | 96/109 |

*Primary Examiner*—Won H. Louie, Jr.
*Attorney, Agent, or Firm*—Sughrue, Rothwell, Mion, Zinn & Macpeak

[57] ABSTRACT

A silver halide light-sensitive material which comprises a light-sensitive silver halide emulsion containing a compound represented by the following formula (I):

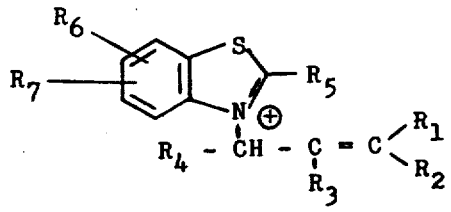

(I)

wherein $R_1$, $R_2$, $R_3$, $R_4$ and $R_5$ each represents a hydrogen atom or a lower alkyl group; and $R_6$ and $R_7$ each represents a hydrogen atom, a lower alkyl group or a lower alkoxy group or can combine to form a condensed ring, and $X^-$ represents an anion.

9 Claims, No Drawings

SILVER HALIDE EMULSION CONTAINING AN ALKENYL BENZOTHIAZOLIUM SALT AS STABILIZER

BACKGROUND OF THE INVENTION

1. Field of the Invention

The present invention relates to silver halide light-sensitive materials and particularly to silver halide light-sensitive materials wherein latent image fading is inhibited.

2. Description of the Prior Art

It is well known that two processes, that is, image exposure for forming latent images and development for converting the latent images into silver images or dye images are required for obtaining images with a silver halide photographic process (refer to, for example, C.E.K. Mees & T.H. James, *The Theory of the Photographic Process* Macmillan & Co.). Formation of the latent image by exposure to light is caused by a minute chemical change of silver halide crystals (refer to Mees & James, supra) and the latent image itself is essentially unstable. Accordingly, the latent image has the property that it easily fades away with the lapse of time between image exposure and development. Such fading of the latent image is called latent image fading. Latent image fading is generally influenced by the storage conditions of the exposed photosensitive material. For example, fading is observed to a great extent at high temperature storage and is observed to a lesser extent at low temperature storage.

The simplest method for avoiding the disadvantage caused by latent image fading comprises carrying out development immediately after exposure to light. A second simple method comprises cooling the exposed photosensitive material and storing it at a low temperature for the time period between image exposure and development processing. Although these methods are the easiest solutions from a chemical viewpoint, when the convenience of users is considered it is difficult to say that they are preferred solutions. From a practical standpoint, photographic negative materials and photographic reversal materials are often left at room temperature for several months between image exposure and development processing, and positive materials for duplication are sometimes left for a few days.

For the above described reason, the production of photosensitive materials wherein latent image fading is inhibited by a specific means at preparation of silver halide photosensitive materials is desired, and thus many methods have been attempted hitherto. However, as the result of detailed studies it has been found the use of hydroxyl group substituted aromatic compounds as described in German Patent No. 1,107,508, 1,3-diones as described in U.S. Pat. No. 3,447,926 or nitrilotriacetic acid as described in U.S. Pat. No. 3,318,702, the process described in U.S. Pat. No. 3,424,583 and the process described in German Patent No. 1,173,339 are all insufficient to attain such an object.

SUMMARY OF THE INVENTION

As the result of much research on inhibiting latent image fading, it has now been found that benzothiazolium compounds represented by the following general formula (I)

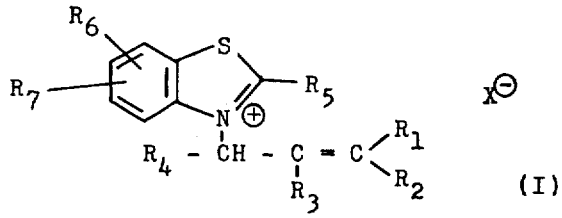

(I)

wherein $R_1$, $R_2$, $R_3$, $R_4$ and $R_5$ each represents a hydrogen atom or a lower alkyl group ($C_1$–$C_4$); and $R_6$ and $R_7$ each represents a hydrogen atom, a lower alkyl group ($C_1$–$C_4$), or a lower alkoxy group ($C_1$–$C_4$), or can combine to form a condensed ring; in a silver halide photographic emulsion have a surprisingly high effect on preventing latent image fading.

DETAILED DESCRIPTION OF THE INVENTION

In the compound represented by the formula (I) above, suitable lower alkyl groups having 1 to 4 carbon atoms for $R_1$ to $R_7$ are a methyl group, an ethyl group, a propyl group, an iso-propyl group, a butyl group, an iso-butyl group, or a tertiary-butyl group and suitable examples of lower alkoxy groups having 1 to 4 carbon atoms for $R_6$ and $R_7$ are a methoxy group, an ethoxy group, a propoxy group, an iso-propoxy group, a butoxy group, an iso-butoxy group or a tertiary-butoxy group. In addition, a suitable example of a condensed ring formed by the combination of $R_6$ and $R_7$ is a benzene ring, and $X^-$ represents an anion.

Analogous compounds wherein the substituent on the nitrogen atom is an alkyl group have been described as antifogging agents as disclosed in British Patent No. 522,997. However, there is a very large difference in the function in photographic emulsions between these known compounds and the compounds of the present invention represented by the general formula (I) as will be clear from the following examples. Namely, an unexpectedly surprising fact is that the compounds used in the present invention of the general formula (I) inhibit latent image fading without causing a deterioration of sensitivity — and sometimes, give rise to sensitization. However the known compound, 3-methylbenzothiazolium iodide, causes a reduction in sensitivity and a marked deterioration in latent image storability when it is used in an amount effective to inhibit fogging. The reduction in sensitivity on use of benzothiazolium salts is a general situation which is not limited to only the case of 3-methylbenzothiazolium iodide. For instance, 17 examples of benzothiazolium salts which cause a reduction of sensitivity are described in Japanese Patent Publication No. 38815/1972.

One feature of the chemical structure of the above described compounds of the general formula (I) used in the present invention is that the hydrocarbon group at the N-position is an alkenyl group having a double bond in the $\beta$-position. It is an unexpectedly surprising fact that such a remarkable difference in the function on photographic emulsions exists between the substituent on the N-position being a saturated alkyl group or an alkenyl group.

The compounds represented by the above described formula (I) according to the present invention are preferably used by incorporation in silver halide photographic emulsions.

Although the time of addition of the compounds in the present invention of the general formula (I) is not particularly limited, addition to the emulsion before coating and after chemical ripening is convenient. The most preferred amount of the compounds of the general formula (I) in the present invention varies with the halide composition, the particle size of the silver halide emulsion and other factors. However, in general, a preferred amount can range from about 1 mg to 50 mg and particularly from 2 to 10 mg based on 100 g of the emulsion.

Typical examples of the thiazolium salts represented by the above described formula (I) are shown in the following.

(1)

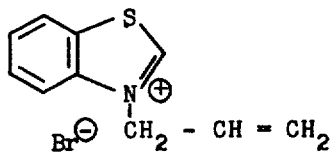

(2)

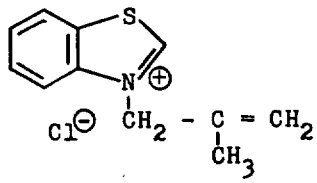

(3)

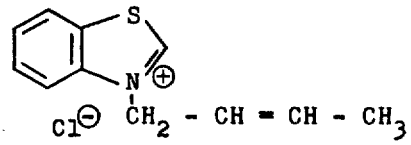

(4)

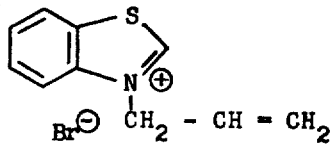

(5)

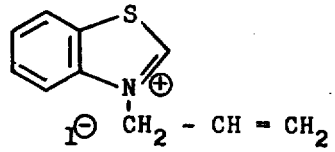

(6)

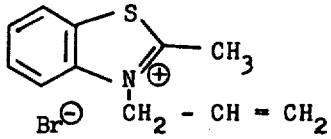

(7)

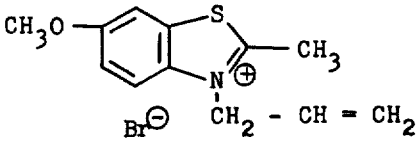

(8)

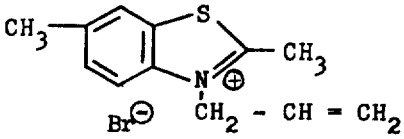

(9)

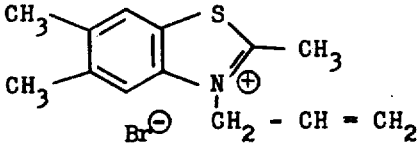

(10)

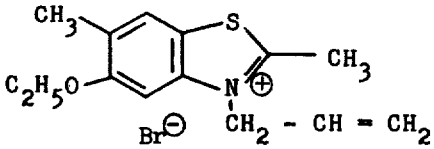

(11)

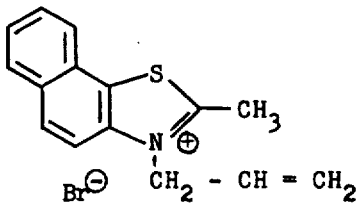

These compounds can be synthesized by reacting a corresponding thiazolium compound with an alkenyl halide. The synthesis of Compound (1) is described in the following, and other compounds can be synthesized similarly.

SYNTHESIS OF 3-ALLYLBENZOTHIAZOLIUM BROMIDE 135 g of benzothiazole and 121 g of allylbromide were mixed and the mixture was heated for 2 hours on a steam bath to solidify by crystallization. After cooling, diethyl ether was added to wash the crystals. After filtration and drying, the crystals obtained were recrystallized from ethanol. Melting point: 145°–147°C.

Confirmation of the chemical structure of the compounds of the general formula (I) used in the present invention was necessary, because the effect on the photographic emulsions containing the compounds was quite different from that of 3-methylbenzothiazolium salts which had been thought to have a structure analogous to the compounds of the general formula (I) in the present invention as described above and will be clear from the examples given hereinafter. As the result of measuring the nuclear magnetic resonance spectra of Compounds (1) and (2), the chemical structure represented by the above general formula (I) was supported, and the measurement distinctly showed the existence of an alkenyl group. Namely, the alkenyl group in Compound (1) exhibited a spectrum which showed an integral proton number intensity corresponding to

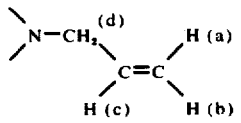

(a) — 5.32 (broad single line)
(b) — 5.48 (broad single line)
(c) — 6.05 (multiple line)
(d) — 5.70 (double line)

and the alkenyl group in Compound (2) exhibited that corresponding to

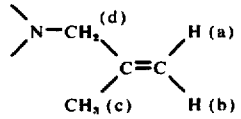

(a)— 4.95 (broad single line)
(b) — 5.05 (broad single line)
(c) — 1.75 (single line)
(d) — 5.77 (single line)

In the photographic emulsion used in the present invention, various silver halides such as silver chloride, silver bromide, silver bromochloride, silver iodobromide and silver iodobromochloride can be employed. These silver halides can be those composed of coarse grains or fine grains, or can have a structure corresponding to a cubic system, an octahedron system or a mixed crystal system. The grain size can be varied over a wide range, but in general, a mean grain size from about 0.05 $\mu$ to about 3 $\mu$ is suitable.

The photographic emulsions can be those produced by precipitation using conventional methods, that is, those produced by a single jet method or a twin jet method. Further, the emulsions can be those having a uniform grain form or a uniform grain size produced by a control twin jet method or those having a broad grain size distribution. Furthermore, the emulsions can be those prepared by mixing two or more silver halide emulsions which have been separately produced. The silver halide emulsions used in the present invention can be those produced using various known methods, as described in, for example, C.E.K. Mees and T.H. James *The Theory of the Photographic Process* MacMillan Co., or P. Grafkides, *Photographic Chemistry* Fountain Press, namely, a neutral method, an acid method or an ammonia method. Particularly, emulsions produced by the neutral method or the acid method are preferred. Further, the core part and the shell part of the silver halide crystal can be homogeneous or can be heterogeneous so as to form a laminar structure.

The photographic emulsions used in the present invention can be those processed by physical ripening. Further, the emulsions can be chemically sensitized using the methods as described in Mees and James, supra, or Grafkides, supra, or using other methods. Namely, compounds which form silver sulfide by reacting with silver salts, such as sulfur compounds or thiosulfate compounds as described in U.S. Pat. Nos. 1,574,944, 2,278,947, 2,410,689, 3,189,458 and 3,501,313 and French Patent No. 2,059,245, can be added to the photographic emulsions or sensitized gelatin which is supposed to contain such compounds can be used. Further, stannous salts, amines or other reducing sensitizer materials as described in U.S. Pat. Nos. 2,487,850, 2,518,698, 2,521,925, 2,521,926 2,419,973, 2,694,637 and 2,983,610 can -diethyloxacarbocyanine added. Furthermore, various gold compounds or gold thiosulfate complex salts as described in U.S. Pat. Nos. 2,597,856, 2,597,915 and 2,399,083 can be added. Similarly, salts of noble metals such as platinum, palladium, iridium, rhodium and ruthenium as described in U.S. Pat. Nos. 2,448,060, 2,566,245 and 2,566,263 can be added. A particularly preferred photographic emulsion for the present invention is an emulsion sensitized using gold sensitization and sulfur sensitization.

Many kinds of compounds can be added to the photographic emulsions in order to prevent a reduction of sensitivity or a generation of fog during preparation of the photosensitive materials, during the storage thereof or during the processing thereof. Quite a number of compounds, for example, many heterocyclic compounds as well as 4-hydroxy-6-methyl-1,3,3a,7-tetrazaindene, 3-methyl-benzothiazole and 1-phenyl-5-mercapto-tetrazole, mercury containing compounds, mercapto compounds and metal salts which are well-known, can be employed. Examples of these compounds which can be used have been described not only in C.E.K. Mees & T.H. James *The Theory of the Photographic Process* 3rd Edition, pages 344 and 346, MacMillan Co. (1966) but also in the following patents: U.S. Pat. Nos. 1,758,576, 2,110,178, 2,173,628, 2,697,040, 2,304,962, 2,324,123, 2,394,198, 2,444,605 -8, 2,566,245, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Patents Nos. 893,428, 403,789, 1,173,609 and 1,200,188.

Further, it is possible to increase the light-sensitivity of the photographic emulsions used in the present invention by adding thereto quaternary ammonium salts as described in U.S. Pat. Nos. 2,271,623, 2,288,226 and 2,334,864 and Belgian Patent No. 620,339, polyethylene glycol derivatives as described in U.S. Pat. No. 2,708,162, thioether compounds as described in U.S. Pat. Nos. 3,046,132-5 or diketone compounds as described in Belgian Patents Nos. 618,139 and 681,140 and British Patent No. 939,357.

Furthermore, it is possible to add known many kinds of surface active agents to the photographic emulsions used in the present invention as a coating assistant or as an agent for improving the wetting property. Namely, saponin, polyethylene glycol ethers as described in U.S. Pat. No. 2,831,766, acylated taurines as described in U.S. Pat. No. 2,739,891, maleopimelates as described in U.S. Pat. No. 2,823,123 and the compounds described in Japanese Patent Publications Nos. 10247/1968, 8401/1969 and 21983/1971 can be added.

Moreover, hardening agents such as formaldehyde, halogenated acids as described in U.S. Pat. No. 2,080,017, acid anhydrides and acid halides as described in U.S. Pat. Nos. 2,725,294 and 2,725,295, chlorotriazine as described in Japanese Patent Publication No. 6151/1972, 2,3-dihydroxydioxane or sodium bisulfite adducts of dialdehydes can be used for the photographic emulsions of the present invention.

Suitable protective colloidal polymers or binder polymers for the silver halide grains of the photographic emulsions of the present invention include gelatin, gelatin derivatives such as phthalated gelatin and maleated gelatin and polyvinyl alcohol. Further, polyvinyl pyrrolidone, polysaccharides and water soluble copolymers of acrylic acid or acrylates can be added alone or as a mixture thereof. Furthermore, various plasticizers and emulsion polymer latexes can be used in order to improve the physical properties of gelatin films.

The photographic emulsions of the present invention can be spectrally sensitized using many kinds of spectral sensitizers, as described in Mees and James, supra, and U.S. Pat. Nos. 2,493,747, 3,493,748 and 2,503,776.

The light-sensitive materials can be produced by applying the silver halide photographic emulsions of the present invention to a support. The supports which can used in the present invention are not limited. Typical examples of supports include transparent, semi-transparent and opaque supports such as polyester films, cellulose acetate films, polystyrene films, polycarbonate films, polypropylene films, laminated films of these polymers, glass plates, baryta papers, resin coated papers such as polyethylene laminated papers and metal plates, etc.

The photographic emulsions of the present invention can be used for black-white negative photosensitive materials, positive photosensitive materials, X-ray films, photosensitive materials for the graphic arts (lithographic films), color photosensitive materials which contain oil-soluble or water-soluble color couplers, black-and-white photosensitive materials for the diffusion transfer process and color photosensitive materials for the diffusion transfer process.

The following examples are given to illustrate the present invention in greater detail. Unless otherwise indicated, all parts, percents, ratios and the like are by weight.

EXAMPLE 1

To 100 g of a high speed negative silver iodobromide emulsion (iodide: 7% by mol) sensitized with sulfur sensitization and gold sensitization, the compounds of the present invention of the general formula (I) in the amount described in the following Table 1, 5 ml of a 1% aqueous solution of 4-hydroxy-6-methyl-1,3,3a,7-tetrazaindene, 2 ml of a 2% aqueous solution of 2,4-dichloro-6-hydroxy-1,3,5-triazine sodium salt as a hardening agent and 2 ml of a 1% aqueous solution of sodium dodecylbenzene sulfonate as a coating assistant were added. Each emulsion was then applied to a cellulose triacetate film to produce photosensitve materials.

These photosensitive materials were exposed to light using a light source having a color temperature of 4800°K for 1/100 second through a light wedge having a step difference of 0.1 (10 CMS) and developed for 2 minutes at 37°C using a developer having the following composition.

| Developer Composition: | |
|---|---|
| Sodium Sulfite | 90 g |
| N-Methyl-p-aminophenol | 2 g |
| Hydroquinone | 8 g |
| Sodium Carbonate (monohydrate) | 53 g |
| Potassium Bromide | 5 g |
| Potassium Thiocyanate | 1 g |
| Water to make | 1 liter |

Then the materials were subjected to fixation and water washing. The relative speed of the photographic material developed just after exposure and that of the photographic material developed after being allowed to stand for 10 days at room temperature (20°C) after exposure are shown in Table 1. The degree of latent image fading can be evaluated by a comparison of the values of the relative speeds shown in this table.

TABLE 1

| | | Relative Speed | |
|---|---|---|---|
| Compound | Amount Added (mg/100g Emulsion) | Developed Just After Exposure | Developed After Storage for 10 Days at Room Temperature After Exposure |
| Control | None | 100 | 80 |
| N-Methylbenzothiazolium Iodide 1) | 2.5 | 110 | 80 |
| | 5.0 | 100 | 70 |
| | 10.0 | 60 | 30 |
| Compound (1) | 2.5 | 140 | 120 |
| | 5.0 | 160 | 160 |
| | 10.0 | 140 | 140 |
| Compound (2) | 2.5 | 110 | 90 |
| | 5.0 | 130 | 120 |
| | 10.0 | 130 | 130 |
| Compound (5) | 2.5 | 130 | 110 |
| | 5.0 | 160 | 160 |
| | 10.0 | 140 | 140 |
| Compound (6) | 2.5 | 100 | 85 |
| | 5.0 | 90 | 85 |

TABLE 1-continued

| Compound | Amount Added (mg/100g Emulsion) | Relative Speed: Developed Just After Exposure | Relative Speed: Developed After Storage for 10 Days at Room Temperature After Exposure |
|---|---|---|---|
| | 10.0 | 90 | 90 |

1) Known compound for comparison

The sample which did not contain a benzothiazolium compound was used as a control. The relative speed of the control sample which was developed just after exposure is shown as 100. The speed was determined from the exposure corresponding to D = 1.0 on the characteristic curve.

It can understood from the results in Table 1 that the relative speed of the sample developed after storage for 10 days at room temperature after exposure is not much lower than the relative speed of the sample developed just after exposure when the benzothiazolium compound of the present invention is added to the sample, while the reduction of the relative speed becomes large when the known compound is used. It can be understood from this result that the compounds of the general formula (I) used in the present invention unexpectedly having excellent effects in inhibiting latent image fading.

EXAMPLE 2

To 100 g of a sulfur sensitized silver bromochloride emulsion (bromide: 70% by mol) for a color paper (silver content: 0.05 mol/100 g emulsion), the compounds of the present invention of the general formula (I) in the amount described in the following Table 2, 5 ml of a 0.1% methanol solution of 3,3'-disulfopropyl-9-ethyl-5,5'-diethylooxacarbocyanine iodide as a spectral sensitizer and 60 g of a magenta coupler dispersion having the following composition were added. Further, 4 ml of a 2% aqueous solution of 2,4-dichloro-6-hydroxy-1,3,5-triazine sodium salt asa hardening agent was added thereto. The emulsion was applied to a paper support, both surfaces of which had been coated with polyethylene containing titanium dioxide. The applied silver content was 0.004 mols Ag/cm² of the support. After exposure to light for one-half second through a light wedge having a step difference of 0.1 (500 CMS), the materials were processed in the following processings. In the processings the following processing solutions were used. Color development was carried out at 30°C for 4 minutes, bleach-fixation was carried out at 30°C for 2 minutes and stabilization was carried out at 30°C for 2 minutes.

| | |
|---|---|
| **Magenta Coupler Dispersion Composition:** | |
| 1-(2,4,6-Trichlorophenyl)-3-(3-α-(2,4-di-t-amylphenoxy)butyramido)-benzamido-5-pyrazolone | 100 g |
| Tricresyl Phosphate | 50 g |
| Ethyl Acetate | 200 g |
| Gelatin (10% aqueous solution) | 1,000 g |
| Sodium Dodecylbenzene Sulfonate (5% aqueous solution) | 100 g |
| **Color Developer Composition:** | |
| Sodium Metaborate | 25 g |
| Sodium Sulfite | 2 g |
| Hydroxylamine Sulfate | 2 g |
| Potassium Bromide | 0.5 g |
| 6-Nitrobenzimidazole | 0.02 g |
| Sodium Hydroxide | 4 g |
| Benzyl Alcohol | 16 ml |
| N-Ethyl-N-α-methanesulfonamidoethyl-p-phenylenediamine | 8 g |
| Water to make | 1 liter |
| **Bleach-Fixing Solution Composition:** | |
| EDTA - $Fe^{III}$ | 45 g |
| Ammonium Thiocyanate | 10 g |
| Sodium Sulfite | 10 g |
| Ammonium Thiosulfate | 60 g |
| Water to make | 1 liter |
| **Stabilizing Solution Composition:** | |
| Citric Acid | 10 g |
| Zinc Sulfate | 10 g |
| Sodium Metaborate | 20 g |
| Water to make | 1 liter |

The relative speed of the photographic material processed just after exposure and that of the photographic material processed after storage for 48 hours at 25°C after exposure are shown in Table 2. The degree of the latent image fading can be seen from Table 2.

TABLE 2

| Compound | Amount Added (mg/100g Emulsion) | Relative Speed: Processed Just After Exposure | Relative Speed: Processed After Storage for 48 Hours at 25°C After Exposure |
|---|---|---|---|
| Control | None | 100 | 80 |
| Compound (1) | 2.5 | 100 | 90 |
| | 5.0 | 100 | 95 |
| | 10.0 | 95 | 93 |
| | 15.0 | 90 | 90 |
| Compound (3) | 2.5 | 110 | 95 |
| | 5.0 | 100 | 95 |
| | 10.0 | 95 | 95 |
| | 15.0 | 95 | 95 |
| Compound (5) | 2.5 | 100 | 90 |
| | 5.0 | 98 | 95 |
| | 10.0 | 92 | 92 |
| | 15.0 | 90 | 90 |

The sample which did not contain the benzothiazolium compound was used as a control. The relative speed of the control sample which was developed just after exposure is shown as 100. The speed was determined from the exposure corresponding to D = 1.0 on the characteristic curve.

It can be seen from the results in Table 2 that the compounds of the present invention of the general formula (I) have excellent effects in inhibiting latent image fading, because reduction in the relative speed of the materials containing the compounds of the present invention of the general formula (I) is small.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material comprising a silver halide light-sensitive emulsion containing a compound represented by the following formula (I):

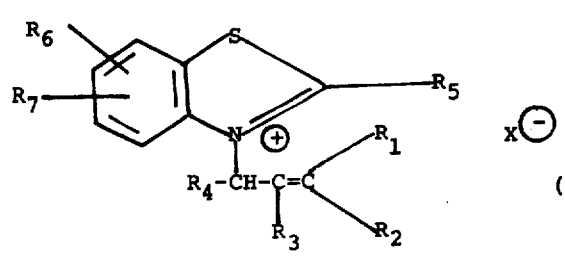

(I)

wherein $R_1$, $R_2$, $R_3$, $R_4$ and $R_5$ each represents a hydrogen atom or a lower alkyl group; and $R_6$ and $R_7$ each represents a hydrogen atom, a lower alkyl group, or a lower alkoxy group, or can combine to form a benzene ring and $X^-$ represents an anion, in an amount effective to prevent fading of the silver halide latent image formed upon image-wise exposure of said silver halide light-sensitive emulsion.

2. The silver halide light-sensitive material of claim 1, wherein said lower alkyl group is a methyl group, an ethyl group, a propyl group, an iso-propyl group, a butyl group, an iso-butyl group, or a tertiary-butyl group, and wherein said lower alkoxy group is a methoxy group, an ethoxy group, a propoxy group, an iso-propoxy group, a butoxy group, an iso-butoxy group, or a tertiary-butoxy group.

3. The silver halide light-sensitive material of claim 1, wherein said compound represented by the formula (I) is present in said emulsion in an amount of about 1 mg to 50 mg per 100 g of said emulsion.

4. The silver halide light-sensitive material of claim 1, wherein said compound represented by the formula (I) is

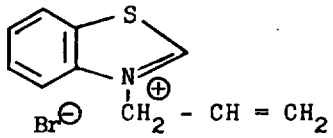

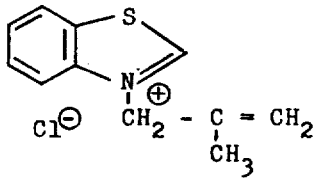

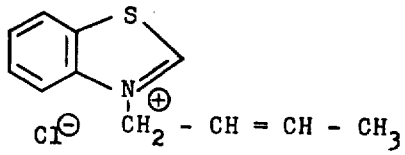

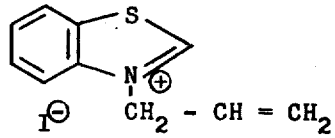

or

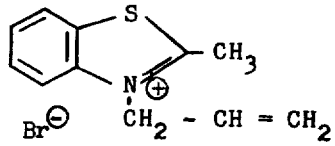

5. The silver halide light-sensitive material of claim 1, wherein said silver halide is silver chloride, silver bromide, silver bromochloride, silver iodobromide or silver iodobromochloride.

6. The silver halide light-sensitive material of claim 1, wherein said silver halide light-sensitive emulsion is a chemically sensitized silver halide light-sensitive emulsion.

7. The silver halide light-sensitive material of claim 1, wherein said silver halide light-sensitive emulsion is a spectrally sensitized silver halide light-sensitive emulsion.

8. The silver halide light-sensitive material of claim 1, wherein said silver halide light-sensitive emulsion includes a color coupler.

9. A photographic material comprising a support having thereon the silver halide light-sensitive material of claim 1.

* * * * *